United States Patent [19]

Moriarty, Jr.

[11] Patent Number: 4,590,419

[45] Date of Patent: May 20, 1986

[54] CIRCUIT FOR GENERATING A TEMPERATURE-STABILIZED REFERENCE VOLTAGE

[75] Inventor: John K. Moriarty, Jr., Gaithersburg, Md.

[73] Assignee: General Motors Corporation, Detroit, Mich.

[21] Appl. No.: 668,428

[22] Filed: Nov. 5, 1984

[51] Int. Cl.[4] ..... G05F 3/30

[52] U.S. Cl. ..... 323/313; 323/907

[58] Field of Search ..... 323/311, 313, 314, 907; 307/297

[56] References Cited

U.S. PATENT DOCUMENTS

| | | | |
|---|---|---|---|
| 3,781,648 | 12/1973 | Owens | 307/297 |
| 3,794,861 | 2/1974 | Bernacchi | 307/297 |
| 4,064,448 | 12/1977 | Eatok | 307/297 |
| 4,100,436 | 7/1978 | Van De Plessche | 307/297 |
| 4,249,122 | 2/1981 | Widlar | 323/313 |
| 4,460,865 | 7/1984 | Bynum et al. | 323/313 |
| 4,506,208 | 3/1985 | Nagano | 307/297 |

FOREIGN PATENT DOCUMENTS

| | | | |
|---|---|---|---|
| 164413 | 12/1981 | Japan | 323/313 |

*Primary Examiner*—William H. Beha, Jr.
*Attorney, Agent, or Firm*—Howard N. Conkey

[57] ABSTRACT

A temperature-stabilized voltage is generated based on the positive temperature coefficient difference in the base-to-emitter voltages of a pair of transistors operating at different current densities and a negative temperature coefficient voltage developed from the base-to-emitter voltage of a transistor.

2 Claims, 1 Drawing Figure

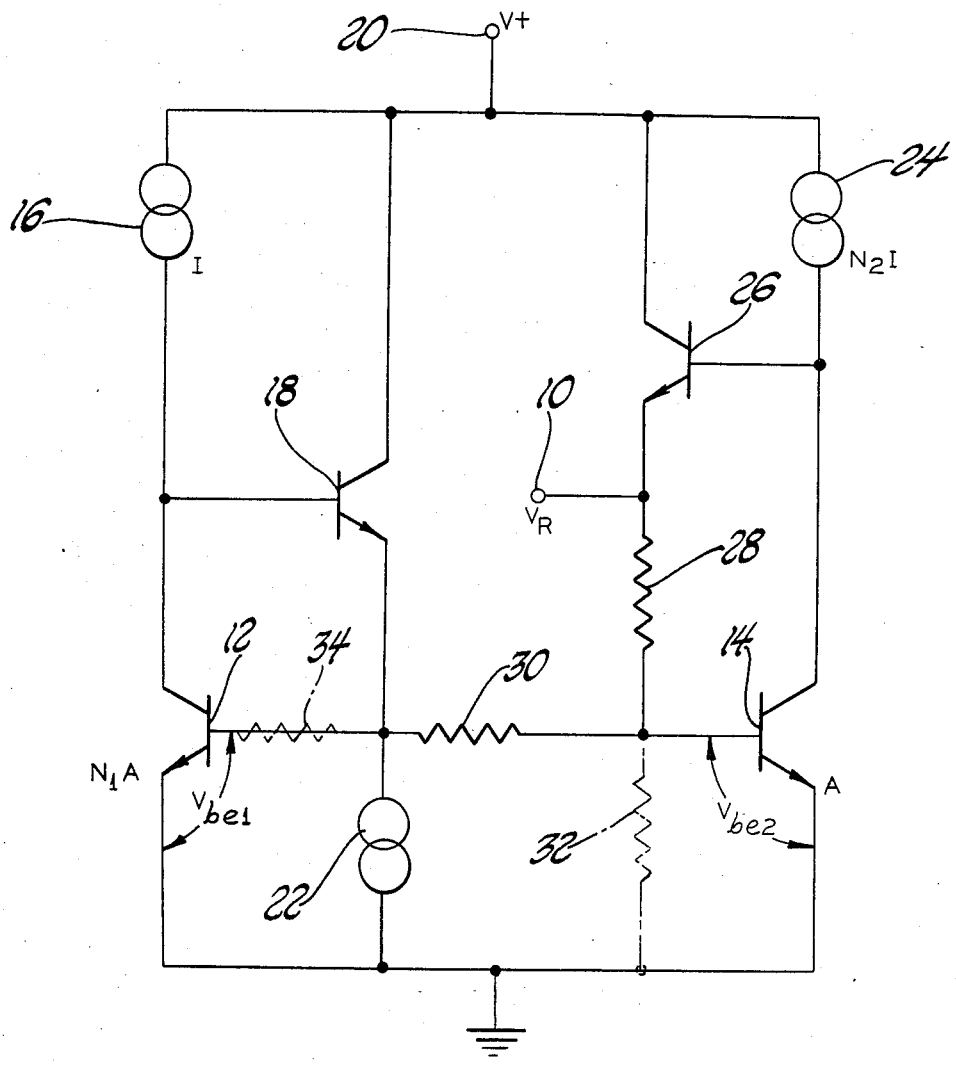
20
V+
16
I
24
N2I
26
18
10
VR
28
12
34
30
14
N1A
Vbe1
A
Vbe2
32
22

CIRCUIT FOR GENERATING A TEMPERATURE-STABILIZED REFERENCE VOLTAGE

This invention relates to a monolithic integrated circuit for producing a constant temperature-stabilized output reference voltage.

In many circuit applications such as in voltage supplies, constant voltage references are often required. Typically, it is desirable to provide for a reference voltage that has an absolute known magnitude that is substantially independent of temperature variations. Band gap voltage reference circuits have been developed in integrated circuitry in which the fundamental electronic properties of the semiconductor material are employed to develop a temperature stabilized reference voltage. It is to this form of reference circuit to which the subject invention is directed.

The invention may be best understood by reference to the following description of a preferred embodiment and the single figured drawing which is a circuit diagram of a voltage reference circuit illustrating the principles of this invention.

Referring to the drawing, a monolithic integrated circuit is illustrated to provide a temperature independent reference voltage $V_R$ at an output terminal 10. In general, the reference voltage $V_R$ is the sum of two voltage components, one having a positive temperature coefficient and one having a negative temperature coefficient. The positive temperature component is generated based on the difference in the base-emitter junction voltages of a pair of transistors operating at different current densities and the negative temperature component is generated based on the base-emitter junction voltage of a transistor.

The integrated circuit includes a pair of NPN matched bipolar junction transistors 12 and 14 having respective emitter areas $N_1A$ and A established during fabrication of the integrated circuit and each being biased by respective independent biasing circuits to establish respective emitter currents I and $N_2I$ so that the two transistors are operated at a constant predetermined current density ratio. The emitters of the transistors are coupled together and to a reference voltage such as ground potential.

The biasing circuit for biasing the transistor 12 to the conduction level at which its emitter current is equal to the value I includes a current source 16 for supplying the current I, a feedback transistor 18 and a current sink 22. The current source 16 is coupled between a positive supply voltage terminal 20 at which a positive voltage V+ is applied and the collector of the transistor 12. The feedback transistor 18 has its base coupled to the collector of the transistor 12, its collector coupled to the positive supply voltage terminal 20 and its emitter coupled to the base of the transistor 12 and to ground through the current sink 22.

Transistor 18 is biased conductive by the current source 16 to provide a base drive current to the transistor 12 at a level so that the emitter current of the transistor 12 is substantially at the current I provided by the current source 16, the base current of the transistor 18 being negligible relative to the value I. When the emitter current of the transistor 12 becomes less than I, base drive to the transistor 18 increases which in turn increases the base drive of the transistor 12 to restore the emitter current to the value I. Similarly, when the emitter current of the transistor 12 becomes greater than I, base drive to the transistor 18 decreases to decrease the base drive of the transistor 12 to restore the emitter current to the value I.

When the current through the transistor 12 is established at the current I, the base-emitter junction current density is determined by the emitter area $N_1A$ of the transistor 12 and the magnitude I of the emitter current. Under these conditions, the base-emitter junction voltage of the transistor 12 is equal to $V_{be1}$ having a negative temperature coefficient.

The bias circuit for biasing the transistor 14 so as to conduct the emitter current $N_2I$ is also in the form of a feedback circuit. This circuit includes a current source 24 for supplying the current $N_2I$, a feedback transistor 26, and a resistor 28. The current source 24 is coupled between the collector of the transistor 14 and the positive supply voltage terminal 20. The feedback transistor 26 has its base connected to the collector of the transistor 14, its collector coupled to the positive supply voltage terminal 20 and its emitter coupled to the output terminal 10 and to the base of the transistor 14 through the resistor 28. In the same manner as the transistor 12, the biasing circuit for the transistor 14 functions to establish an emitter current that is equal to the value $N_2I$ provided by the current source 24. When the emitter current is established at the current $N_2I$, the base-emitter junction current density is determined by the emitter area A of the transistor 14 and the magnitude $N_2I$ of the emitter current. Under these conditions, the base-emitter junction voltage of the transistor 14 is equal to $V_{be2}$ having a negative temperature coefficient. As can be seen from the foregoing, the current sources 16 and 24 are independant of any circuit element values.

Since the emitter area of the transistor 14 is less than the emitter area of the transistor 12 by the factor $N_1$ and since the emitter current established by the current source 24 is $N_2$ times the emitter current of the transistor 12 established by the current source 16, the base-emitter junction current density of the transistor 14 is $N_1N_2$ times the base-emitter current density of the transistor 12. The resulting difference $V_{be2}-V_{be1}$ between the base-emitter junction voltages of the transistors 12 and 14 has a positive temperature coefficient. This positive temperature coefficient difference voltage is sensed by a resistor 30 coupled between the bases of the transistors 12 and 14. The resulting current $I_{30}$ through the resistor 30 comprises the current through the resistor 28 (the base current of the transistor 14 being negligible) which establishes a positive temperature coefficient voltage across the resistor 28 having the value $V_{R28}=K_1(V_{be2}-V_{be1})$, where $K_1$ is a factor equal to the ratio $R_{28}/R_{30}$ and where $R_{28}$ is the resistance of the resistor 28 and $R_{30}$ is the resistance of the resistor 30. The reference voltage at the output terminal 10 is the sum of this positive temperature coefficient voltage and the negative temperature coefficient base-emitter junction voltage of the transistor 14 and is defined by the expression $V_R=K_1(V_{be2}-V_{be1})+K_2V_{be2}$, where $K_2$ is a factor equal to unity in this embodiment.

The foregoing expression for regulated voltage $V_R$ is comprised of one voltage component having a negative temperature coefficient and a second component having a positive temperature coefficient. By proper scaling of the factor $K_1$ by selection of the resistors 28 and 30, the change in the positive temperature coefficient component may be made equal and to the change in the negative temperature coefficient component resulting in the reference voltage $V_R$ being independent of temperature. It can be shown that this condition is established by selecting the resistors 28 and 30 so that the voltage $V_R$ at the output terminal is equal to $K_2V_{go}$, where $V_{go}$ is the semiconductor band gap voltage extrapolated to absolute zero.

A temperature-stabilized reference voltage $V_R$ having any desired value geater than $V_{go}$ may be provided by the addition of a resistor 32. The effect of this resistor is to increase the value of the factor $K_2$ in the above expression by establishing a current component through the resistor 28 having the value $V_{be2}/R_{32}$, where $R_{32}$ is the resistance of the resistor 32. The value of the factor $K_2$ is then equal to $1+R28/R32$. As before, by selection of the ratio of the resistors 28 and 30 so that the voltage $V_R$ is equal to $K_2V_{go}$, the reference voltage is made temperature independent.

The foregoing description has assumed that the transistor base currents are negligible and assumed to be zero. However, a small error may introduced due to non-zero base currents. While in some applications, this small error may be acceptable, in other applications it may be desirable to eliminate this error. This may be accomplished by adding a resistor 34 having resistance $R_{34}$ in base circuit of the transistor 12. By proper selection of the value of the resistance $R_{34}$, all of the base current terms in the expression of the reference voltage may be cancelled. For example, when taking the base currents into consideration, the reference voltage is defined by the expression $V_R=K_1(V_{be2}-V_{be1})+K_2 \cdot V_{be2}-R_{34}R_{28}I_b/R_{30}+N_2R_{28}I_b$, where $I_b$ is the base current of the transistor 12. It can be seen that by making $R_{34}=N_2R_{30}$, the base current terms cancel and the reference voltage $V_R$ is independent of the non-zero base currents.

The detailed description of the preferred embodiment of this invention for the purposes of explaining the principles thereof is not to be considered as limiting or restricting the invention since many modifications may be made by the exercise of skill in the art without departing form the scope of the invention.

The embodiments of the invention in which an exclusive property or privilege is claimed are defined as follows:

1. A monolithic integrated circuit for producing an output voltage $V_R$, comprising:

first and second matched bipolar junction transistors each having a base, collector and emitter;

means for coupling the emitters of the first and second transistors so that their potentials are substantially equal;

means for providing a bias to the base of the first transistor to establish the base-emitter junction current density of the first transistor at a constant first value to provide a base-emitter junction voltage value $V_{be1}$ having a negative temperature coefficient;

a feedback circuit responsive to the emitter current of the second transistor for biasing the base of the second transistor to maintain a base-emitter junction current density of the second transistor at a constant second value to provide a base-emitter junction voltage value $V_{be2}$ having a negative temperature coefficient;

a resistor coupled between the bases of the first and second transistors so as to develop across the resistor a voltage substantially equal to $V_{be2}-V_{be1}$, the value $V_{be2}-V_{be1}$ having a positive temperature coefficient; and resistance means in the feedback circuit series coupled with the base-emitter junction of the second transistor, the sum of the voltage across the resistance means and the base-emitter junction of the second transistor comprising the output voltage $V_R$ having the value $K_1(V_{be2}-V_{be1})+K_2V_{be2}$, where $K_1$ and $K_2$ are factors determined to provide the voltage $V_R$ equal to $K_2V_{go}$, where $V_{go}$ is the semiconductor band gap voltage extrapolated to absolute zero, whereby the voltage $V_R$ is substantially independent of variations in temperature.

2. The monolithic integrated circuit of claim 1 further including a second resistor coupled in parallel with the base and emitter of the second transistor and wherein the factor $K_2$ has a value equal to $1+R1/R2$ where R1 is the resistance of the resistance means and R2 is the resistance of the second resistor.

* * * * *